United States Patent [19]

Okabayashi et al.

[11] Patent Number: 4,480,988

[45] Date of Patent: Nov. 6, 1984

[54] SURFACE COMBUSTION TYPE BURNER WITH AIR SUPPLY ENTIRELY AS PRIMARY AIR

[75] Inventors: Makoto Okabayashi, Nabari; Yasuo Takeishi, Osaka; Yoichi Higuchi, Katano; Kazuto Taguchi, Sakai, all of Japan

[73] Assignee: Osaka Gas Company, Limited, Osaka, Japan

[21] Appl. No.: 378,977

[22] Filed: May 17, 1982

[51] Int. Cl.[3] ..... F23D 13/14

[52] U.S. Cl. ..... 431/329; 431/347; 126/92 R

[58] Field of Search ..... 431/329, 100, 347; 126/92 R, 92 AC, 110 D, 110 C, 110 B, 110 R; 239/145, 418, 423, 590.3, DIG. 23; 60/738, 749, 39.82 N

[56] References Cited

U.S. PATENT DOCUMENTS

| | | | |
|---|---|---|---|
| 3,169,572 | 2/1965 | Constance et al. | 431/329 |
| 3,204,683 | 9/1965 | Ruff et al. | 431/347 X |
| 3,847,534 | 11/1974 | Nomaguchi et al. | 431/329 |
| 4,340,028 | 7/1982 | Hatta et al. | 126/92 R |

FOREIGN PATENT DOCUMENTS

| | | | |
|---|---|---|---|
| 625599 | 8/1927 | France | 431/347 |
| 1362114 | 4/1962 | France | 431/329 |
| 371237 | 3/1958 | Switzerland | 431/329 |

*Primary Examiner*—Randall L. Green
*Attorney, Agent, or Firm*—Edwin E. Greigg

[57] ABSTRACT

A surface combustion type burner with air supply entirely as primary air has metallic netting defining a combustion surface, and is characterized in that in close supporting contact behind the metallic netting, substantially all over the entire rear surface of the metallic netting, there is disposed a punched or perforated metal base which has an open or void perforation ratio smaller than that of the metallic netting.

2 Claims, 8 Drawing Figures

SURFACE COMBUSTION TYPE BURNER WITH AIR SUPPLY ENTIRELY AS PRIMARY AIR

BACKGROUND OF THE INVENTION

This invention relates to improvement of surface combustion type burners with single-stage air supply thus entirely as primary air, equipped with metallic netting defining the combustion surface, particularly to such burners suited for high combustion load.

As conventional burners of the surface combustion type there are various different ones as to the way how to provide the combustion surface, thus utilizing therefor a formed ceramic product, metallic netting and so forth, each of them having the respective advantages and disadvantages. It is apparent, however, that those utilizing the metallic netting are practically more favorable than those utilizing the formed ceramic product, in view of lower material cost and of better productivity owing to easy forming operation. As included in such conventional burners utilizing the metallic netting, there indeed are different structures as using the netting in a single layer and in two or more overlapping layers, but they have all been the burners for rather low combustion load. The reason for such restriction in using such type of burners is that the higher the combustion load the more eminent becomes the problems of the higher noxious exhaust $NO_x$ content and the higher tendency of causing backfire owing to excessive burner heating, while that the more excessively supplied the primary air in the intention of thereby solving such problems the higher becomes the tendency of causing lift of the flame to thus result in the higher noxious exhaust CO content. Consequently, it has conventionally been compelled to use such burners in low combustion load range with restricted supply of the air.

SUMMARY OF THE INVENTION

This invention has as its object to provide a surface combustion type burner without the drawbacks of the conventional structures as mentioned hereinabove, as is particularly suited for high combustion load, thus to eliminate the drawbacks while affecting as little as possible the advantages of the surface combustion type burners using metallic netting for providing the combustion surface.

To attain the object, the surface combustion type burner with single-stage air supply thus entirely as primary air, equipped with metallic netting having a front and a rear surfaces, with the front surface defining the combustion surface, is characterized according to this invention in that in close supporting contact behind the metallic netting, substantially all over the entire rear surface thereof, there is disposed a punched or perforated metal base which has an open or void perforation ratio smaller than that of the said metallic netting.

Since the perforated metal base having the void perforation ratio smaller than that of the metallic netting is disposed in close supporting contact behind the netting, suitable pressure of the combustible gas air mixture in a mixture chamber behind the perforated metal base can thereby be sustained thus enabling to widely spread out the combustible gas air mixture within the mixture chamber and ultimately to supply the gas generally uniformly all over the combustion surface composed of metal netting. Also advantageous is the fact that the perforated metal base of rather small void perforation ratio causes quite high a flow speed of the mixture through each perforation thereof, which will effectively prevent the backfire phonomenon. The generally uniformly supplied combustible gas air mixture then undergoes abrupt flow speed retardation and laterally spreading dispersion, while passing through the metalic netting, therefore causing stable flame, even on the solid non-perforated area of the perforated metal base, a small amount of combustion per unit area and therefore small in height, to thus substantially retain the advantageous feature generally of the surface combustion type burners, namely of providing generally uniform heating all over the combustion area. Furthermore, since the combustible gas air mixture undergoes sufficient laterally spreading dispersion and provides the flame, all over the burner area, small in height as mentioned above, which results in providing sufficient flame-sustaining effect for the high-speed jet of the combustible gas air mixture immediately upon coming out of each of the perforations of the perforated metal base; lift of the flame is hardly to occur, even when the burner is used under high combustion load with excessive mixing ratio of primary air in the intention of thereby abating the noxious exhaust $NO_x$ content, to thus result in also abating another noxious exhaust CO content as effectively as possible. Still further, since the perforated metal base is excellent in thermal conductivity and has a larger heat capacity than that of the metal netting, any possible tendency of temporary and localized abnormal heating of the metal netting is effectively suppressed as such thermal non-uniformity in the metal netting is rapidly conducted to the perforated metal base and is there rapidly made uniformly constant, thus to surely prevent the phenomenon of backfire owing to such spotwise or localized abnormal high temperature and therefore to guarantee quite stable combustion. While this burner provides, as above, ideal combustion as is almost optimal as a surface combustion type burner, all over the practical range from low to high combustion load; it is quite simple in structure with addition only of the perforated metal base to a conventional burner using the metal netting, and high productivity can therefore be realized in its manufacture, without ruining the advantage of such conventional burner using only the metal netting, namely the low material cost and simple and easy manufacture.

In this respect, it may be suspected that the favorable result as above is effected simply by the perforated metal base without any substantial synergistic effect of the metal netting and the perforated metal base as used in combination. However, various experiments done by the inventors of this invention have attested that the burner according to this invention is indeed far more favorable than the burner which has no metal netting and has the combustion surface provided directly by the perforated metal base, with respect to backfire and exhaust CO content, to thus clearly show that the said result is actually realized by the synergistic effect of the metal netting and the perforated metal base. Detailed results of such experiments are shown later in this specification.

Still other objects and advantages of this invention will become apparent from the detailed description to follow hereunder;

BRIEF DESCRIPTION OF THE DRAWINGS

The drawings show, by way of example, some embodiments of the surface combustion type burner according to this invention, wherein.

DETAILED DESCRIPTION OF THE PREFERRED EMBODIMENTS

Figure 1:
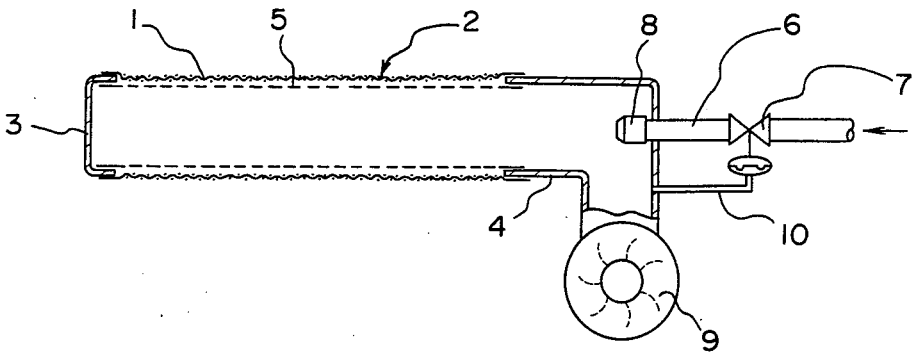
FIG. 1 is a schematic longitudinal sectional view of an embodiment.
Figure 2:
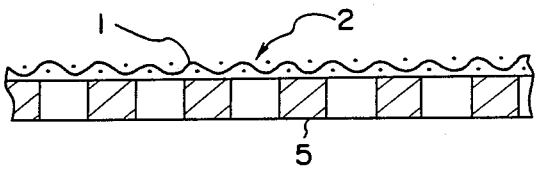
FIG. 2 is an enlarged view of a portion shown in FIG. 1, as is essential to this invention.

Referring first to an embodiment of the surface combustion type burner of this invention shown in FIGS. 1 and 2, designated at (1) is a tubular metallic netting having a front and a rear surfaces, with the front surface defining the combustion surface (2). One longitudinal end of the tubular metalic netting (1) is closed up by a solidly bottomed tubular cap (3), while the other end is connected, in fully open free communication, to a burner body structural portion (4) serving as a supply duct for a gaseous fuel as well as the air. In close supporting contact behind the metalic netting (1), substantially all over the entire rear surface thereof, there is disposed a punched or perforated metal base (5), correspondingly tubular in shape, which has an open or void perforation ratio smaller than that of the same metallic netting (1) and whose longitudinal ends are securely fixed respectively to the said cap (3) and the said burner body structural portion (4), both ends being fitted in such mating parts. Designated at (6) is a pipe securely fixed to the burner body structural portion (4) for supplying therethrough the fuel gas into the space within the burner body structure portion (4). A zero-ballance type pressure regulator (7) is incorporated in this pipe (6), and at a tip end of the pipe (6) there is provided a fuel nozzle (8). To the burner body structural portion (4) there is securely fixed a fan (9), in free communication with the space therewithin so as to forcibly supply the burner primary air thereinto. A regulator-actuating pressure-conducting tube (10) is provided in communication with the space within the burner body structural portion (4) in a position downstream of the fan (9), for leading the pressure to the zero-ballance type pressure regulator (7) so that the same may automatically regulate, in response to the pressure, the fuel supply always to vary substantially in good proportion to the burner primary air regardless of any possible variation by maneuvering the fan (9).

Thus, when the fan (9) is arbitrarily operated to supply the burner primary air into the space or chamber within the burner body structural portion (4), then the fuel gas is supplied in the amount always substantially in proper proportion to the amount of such air as actually supplied, and the resultant gas air mixture is caused to spout through the metalic netting (1) and thereupon to burn at the combustion surface (2). In this meanwhile, since the perforated metal base (5) of rather small void perforation ratio is provided in supporting contact behind or beneath the metalic netting (1), the gas air mixture is properly held within such tubular metal base (5) under an appropriately sustained pressure and is accordingly spread out or dispersed therein effectively wide enough, to thus be ultimately supplied generally uniformly all over the netting (1) area. Such gas air mixture undergoes, while passing through the metalic netting (1), abrupt flow speed retardation and laterally spreading dispersion along the netting (1), therefore causing stable flame, even on the solid non-perforated area of the perforated metal base (5), a small amount of combustion per unit area and therefore small in height, to thus provide generally uniform heating all over the combustion surface area. Furthermore, since such widely spread flame in small height provides sufficient flame-sustaining effect for the high-speed jet of the gas air mixture immediately upon coming out of each of the perforation of the perforated metal base (5); lift of the flame is hardly to occur, even when the burner is used under high combustion load with such excessive mixing ratio of primary air in the intention of thereby abating the noxious exhaust $NO_x$ content, as would inevitably cause considerable lift of the flame in the case of the conventional burners, to thus result in also abating another noxious exhaust CO content as effectively as possible. Still further, since the perforated metal base (5) is excellent in thermal conductivity and has a larger heat capacity than that of the metalic netting (1), any possible tendency of temporary or localized abnormal heating of the metalic netting (1) is effectively suppressed as such irregular heat is rapidly conducted to the perforated metal base (5) and is there rapidly made uniformly constant, thus to surely prevent the phenomenon of backfire owing to such spotwise or localized abnormal high temperature.

Figure 3:
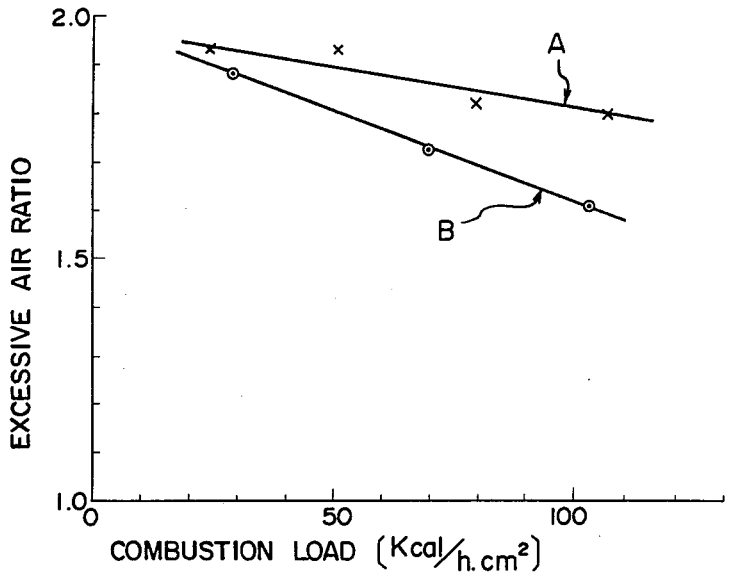
FIG. 3 is a graphical representation of test results showing practically permissible upper limit of excessive mixing ratio of primary air for a range of combustion load, with respect to the burner according to this invention and a burner without metal netting.

In attestation of the merit of this invention, description is now given hereunder on the results of the experiments done by the inventors of this invention, referring to FIG. 3 wherein upper limiting lines, as actually perscribed by occurrence of substantial lift of the flame, for keeping up the exhaust content condition of $CO/CO_2 \leqq 0.01$ when natural gas was used as the fuel, are shown as the curves in accordance with the given coordinates which indicate the combustion load on a given abscissa and excessive air ratio, with respect to the stoicheometric air volume, on a given ordinate, thus the region immediately above the curves is the region off the said condition, with the value of $CO/CO_2$ therefore being slightly over 0.01 there. Curve (A) represents the results obtained with the burner equipped according to this invention with the perforated metal base (5) in close supporting contact behind the metalic netting (1), and curve (B) with a reference burner equipped only with the perforated metal base (5) without combined use of any metalic netting (1). From these results of the experiments, it is apparent that of the said two burners the one according to this invention gives less exhaust CO content when supplied with excessive air in the intention of thereby abating exhaust $NO_x$ content, the more eminent becomes the difference as the higher goes up the combustion load. It is hereby demonstrated that such favorable function as above is brought forth by synergistic effect of the metallic netting (1) and the perforated metal base (5) as used in combination and is thus the peculier merit of this invention.

By the way, the shape of the combustion surface (2) may arbitrarily be selected from the various possibilities such for instance as cyindrical, prismatic, planar and so forth, and further modifications in the structure are also possible for instance as providing either one or both of the perforated metallic base (5) and the metallic netting (1) in multiple overlapping layers. In either case, it should be noted that if and when a gap is caused between the metallic netting (1) and the perforated metal base (5) as they are heated, owing to larger thermal extension of the outer netting (1) than that of the inner base (5), then harmful flaming combustion may occur in such gap, and it is therefore highly desirable, for prevention thereof, to provide the metallic netting (1) and the perforated metal base (5) in such manner as to always retain their mutual close contact even when they are heated to quite high temperature range. More particularly, it is therefore preferable to construct the perforated metal base (5) with a material having larger thermal extension coefficient than that of the material metal of the netting (1), and to construct the metallic netting (1) and the perforated metal base (5) in cylindrical or tubular shape, of course both of them. By way of example, a typical and practical combination of the specific materials, in terminology as prescribed in JIS, namely Japanese Industrial Standard, is the ferrochrome heat-resisting steel of $FCH_2$ or the like for the netting (1) and the nickel-chrome heat-resisting steel of $SUS_3O_4$ or the like for the mating perforated metal base (5).

Figure 4:
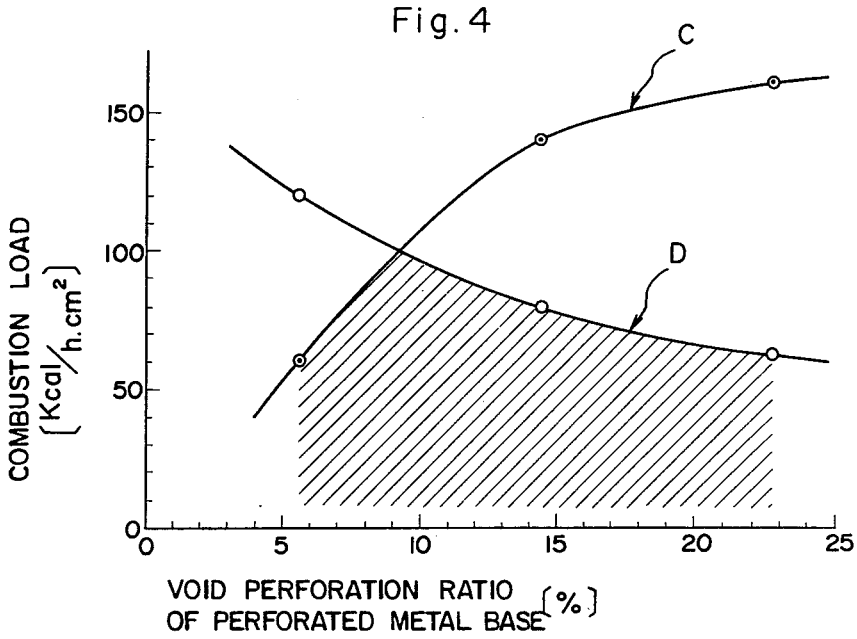
FIG. 4 is a graphical representation of test results showing practically permissible maximum combustion load, without respect to the burner of this invention having the perforated metal base of the respectively selected various void perforation ratios.

The inventors of this invention also made various further experiments to investigate how the exhaust CO and $NO_x$ contents are affected by the shapes of the metallic netting (1) and the perforated metal base (5). Revealed from the results as favorable were those using the metallic netting (1) made of wires of 0.25–0.5 mm diameter in 20–40 mesh, most preferably of 0.3–0.4 mm diameter in 25–35 mesh, and the perforated metal base (5) with 1–2 mm diameter perforations of 3–20% void perforation ratio, most preferably of 5–15% that ratio. Optimal range of the excessive mixing ratio of primary air in the gas air mixture was then revealed as 1.2–1.7 for the natural gas and 1.6–2.1 for the manufactured gas. Shown in FIG. 4 are the results of a partial series among such experiments, made under the condition of the excessive primary air mixing ratio 1.5, using a natural gas as the fuel and the metalic netting (1) of 0.35 mm diameter wires in 32 mesh as well as the perforated metal base (5) of 1.0–2.0 mm diameter perforations, in graphical representation with the combustion load on the ordinate and with the void perforation ratio of the perforated metal base (5) on the abscissa, where curve (C) is an upper limiting line, as actually prescribed by occurrence of substantial lift of the flame, for the exhaust content condition of $CO/CO_2=0.01$ and curve (D) is another entirely different limiting line for 10 mm flame length. It is apparent from the results shown here that the void perforation ratio of the perforated metal base (5) should preferably be not less than 5%. In addition hereto, it is further revealed from another partial series among the experiments, that the said ratio should preferably be not over 15% in view of proper operation without phenomenon of backfire. All in all, it is thus known that the said ratio in the range of 5–15% provides the most preferable results.

The surface combustion type burner according to this invention may find main field of its application for instance in instantaneous water heating assemblies, warm air blowers and various boilers as for baths and the like, but there is no limitation whatsoever in the field of application.

Further description is now given hereunder on the modified embodiments of this invention with reference to FIGS. 5–8, wherein the parts identical with those in the embodiment already described with reference to FIGS. 1 and 2 are designated by the same reference numerals, and repeating the description of such parts are omitted as of no need.

Figure 5:
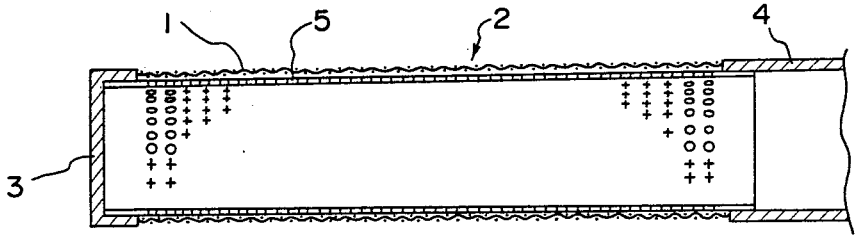
FIG. 5 is a fractional sectional view similar to the lefthand end portion of FIG. 1, but showing here a modified embodiment.

An embodiment shown in FIG. 5 differs from that of FIG. 1 only in that both ends of the metalic netting (1) are not fitted on outer rims of the cap (3) and the burner body structural portion (4), respectively, as seen in FIG. 1, but are securely fixed in longitudinal end-to-end abutment against the cap (3) and the burner body structural portion (4), respectively. This modification is based on the face that providing the metalic netting (1) as fitted on outer rims of such cap (3) and the like as in FIG. 1 tends to let the gas air mixture at such fitted ends flow out along the overall facial surface of the netting (1) thus to build there long flames as may lead to increasing exhaust CO content, but that the flame generally uniform all over the combustion surface (2) may be expected by providing the netting (1) as fixed in longitudinal end-to-end abutment against the cap (3) and the like, thus to enable to further effectively abate exhaust CO content.

Figure 6:
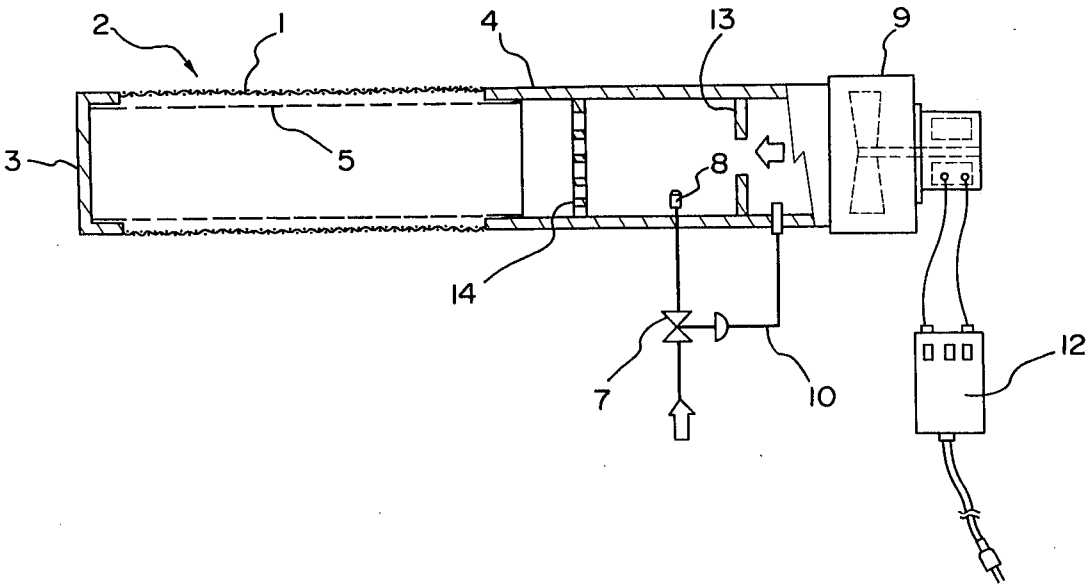
FIG. 6 is a sectional view similar in general to FIG. 1, but showing here another modified embodiment.

Another embodiment is shown in FIG. 6, wherein in a power source circuit for the fan (9) there is provided a maneuvering mechanism (12) for adjustably setting the fan (9) rotation speed, to thereby make it possible to arbitrarily adjust or regulate the output heating rate of this burner and to reasonably save the power for driving the fan (9). In the burner body structural portion (4) downstream of the fan (9) there are disposed an orifice (13) and a plate (14) with multiple perforations, and longitudinally intermediately therebetween there is disposed the fuel nozzle (8), so that the burner air as supplied from the fan (9) and the fuel from the nozzle (8) may be mixed sufficiently enough by the cooperative function of the orifice (13) and the perforated plate (14), to then be supplied towards the combustion surface (2). The regulator-actuating pressure-conducting tube (10) is here provided in communication with the space within the burner body structural portion (4) in between the orifice (13) and the fan (9), so that the mixing ratio of the fuel gas and the burner primary air may always be retained within a set range, regardless of any inadvertent plugging of the metallic netting (1), perforated metal base (5) and perforated plate (14) as well as any alteration of the fan (9) rotation; preferably in the range corresponding to that mentioned hereinabove as is optimal for abating exhaust CO and $NO_x$ contents, namely the excessive primary air mixing ratio range of 1.2–1.7 for the natural gas and 1.6–2.1 for the manufactured gas.

It is thus possible with this burner of FIG. 6, thanks to the flow-path restricting function of the orifice (13) and the regulating function of the zero-balance type pressure regulator (7), to securely retain in a set range the mixing ratio of the fuel and air as supplied towards the combustion surface (2), without regard that any inadvertent plugging of the metalic netting (1) defining the combustion surface (2) and of other parts may occur or that alteration may be caused in the amount of the burner air as supplied by the fan (9), therefore to securely provide the optimal surface combustion, for quite a long while, without causing any substantial lift of the flame, backfire or incomplete combustion. Furthermore, the orifice (13) causes substantial turbulance in the gas air mixture flow to thereby serve for realizing through mixing, this contributing to further enhance and gurantee the stable combustion. Still further, the maneuvering mechanism (12) provides quite convenient means for easily maneuvering the fan (9) rotation speed at any time to thereby adjust the heating output of the burner securely and exactly as desired, in reasonably simple structure, and provides economy in operation from saving the power for driving the fan (9).

Figure 7:
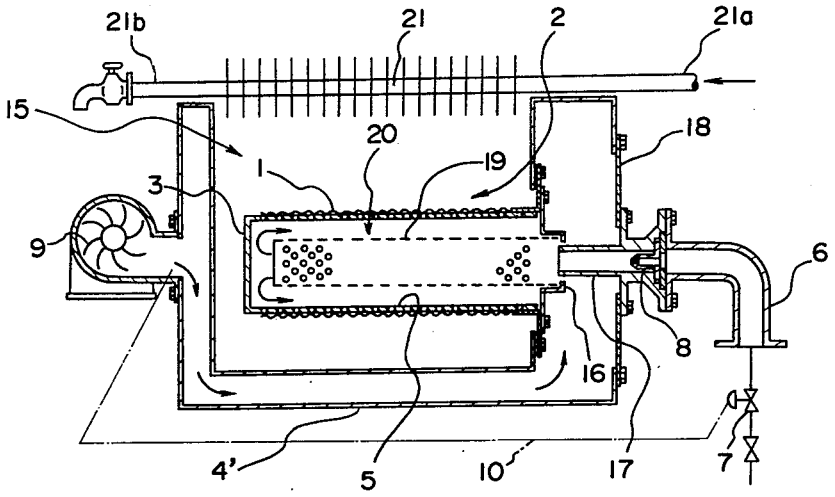
FIGS. 7 and 8 are similar sectional views of the respective further embodiments, both adapted for application as incorporated in instantaneous water heating assembly.

Still another embodiment is shown in FIG. 7, which has a burner body structure portion (4') constructed as a double-wall unit in an open-top box-like shape, and the fan (9) is connected to the space within the double wall, in free communication therewith. The open-top interior space provided by the box-like shape portion (4') serves here as a combustion chamber (15). The metalic netting (1) and the perforated metal base (5) are securely bolted to the burner body structural portion (4') to thus fixedly lie in the combustion chamber (15). Designated here at (16) is an orifice for the air flow, and provided in association therewith as designated at (17) is a sleeve which receives the fuel nozzle (8) in communication hereto. This sleeve (17) is securely bolted to the burner body structural portion (4') with intermediary of a lid (18), in such a manner that a tip end of the sleeve (17) is located close to the orifice (16). The orifice (16) itself is securely fixed to an open-end flow distributor tube (19) made of a perforated solid material or a permeable porous material in cylindrical shape, and this flow distributor tube (19) is in turn securely supported to lie within the metalic netting (1) and the perforated metal base (5) substantially coaxially therewith, with its outer peripheral surface (20) spaced a suitable distance apart therefrom. Thus, some portion of the combustible gas air mixture as is supplied to one end of this flow distributor tube (19) flows permeatingly through the perforations or pores to the outer peripheral surface (20) radially outwardly of the tube (19) while the remaining portion of the gas air mixture flows directly to the other end of the tube (19) longitudinally thereof as may then flow radially outwardly and flow back in a reverse longitudinal direction, as illustrated by arrows, to any portion of the outer peripheral surface (20). By the way, illustrated at (21) is a finned water pipe disposed immediately above the combustion chamber (15) so that the cold water as supplied from the water pipe inlet side (21*a*) may herein be heated up to the hot water as can thus be taken out from the water pipe outlet side (21*b*).

It is thus possible with this burner of FIG. 7, thanks to the function of the flow distrubutor tube (19), to introduce the gas air mixture to the outer peripheral surface (20) of the flow distributor tube (19) through the two different paths, of such radially outward passing through the wall perforations or pores and longitudinally reversing detour flowing with radially outward overriding at the tip end, to thus make the gas air mixture supply to the outer peripheral portion (20) uniform enough and therefore ultimately to provide quite uniform a temperature all over the combustion surface (2) and to effectively restrain any serious burning damage of the combustion-surface-building material owing to spotwise or localized heating to abnormal high temperature thereof. Furthermore, what is needed to make up this burner embodiment is no more than quite simply a modification of particularly incorporating a tube of perforated solid material or permeable porous material, and this is thus a burner quite favorable in view also of the material and manufacturing costs. Still further, constructing the burner body structural portion (4') in box-like shape, with the interior space serving as the combustion chamber (15), has the advantage also of effectively utilizing the heat in the combustion chamber (15) to preheat the burner primary air as supplied from the fan (9) through the burner body structural portion (4'). By the way, there further is a possibility of still enhancing the uniformity of the gas supply, than in the case of using the flow distributor tube (19) of simple uniform void perforation ratio or permeable porosity all over the entire surface, by particularly modifying the spacial distribution of such void perforation ratio or permeable porosity such for instance as making same the smaller at progressive points apart the farther from the gas inlet, in due accordance with the flowing condition of the combustible gas air mixture.

Figure 8:
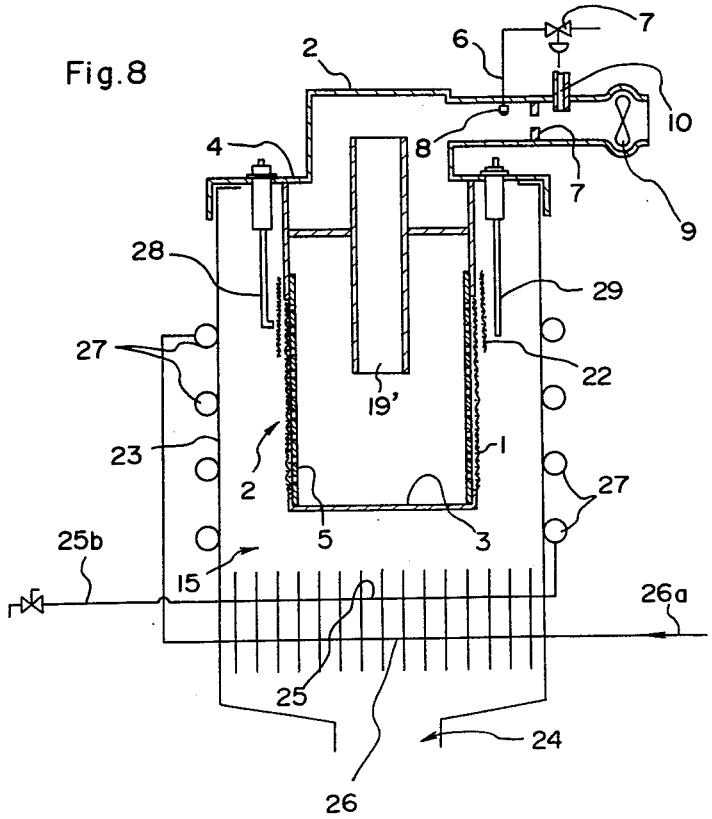

Yet another embodiment is shown in FIG. 8, wherein use of the flow distributor tube (19) of FIG. 7, having the gas-permeable wall, is replaced by use of an open-end flow distributor tube (19') made of normal solid material, thus having the gas-impermeable wall, disposed as clearly seen from FIG. 8. However, as is self-evident to those skilled in the art, this burner of FIG. 8 may possibly use the flow distributor tube (19) of gas-permeable material. As an eminent feature, this embodiment has a flame-sustainer metallic netting (22), disposed as wrapped around as a ring of about 20 mm width along and radially outwardly of the combustion-surface(2)-defining tubular netting (1) near an end portion thereof of the supporting connection to the burner body structural portion (4), as made coarser than this latter-mentioned netting (1), more particularly of preferably 15–20 mesh as made of 0.35 mm diameter wires. Designated in this schematic illustration at (23) is a casing to define the combustion chamber (15) therein, with a burnt gas exhaust discharge outlet (24) formed in a bottom portion of the casing (23). Designated at (25) and (26) are finned water pipes disposed in the lower portion of the combustion chamber (15). More particularly, an outlet end water pipe portion (25) is disposed upstream of an inlet end water pipe portion (26), with respect to the flow of the burnt gas, with an intermediate water pipe portion (27) interconnecting the inlet and outlet end portions (25), (26) being helically wrapped around the wall of the casing (23) in close contact thereto at the portion thereof corresponding to the effective combustion chamber (15). In this way, this whole entirety is made up as an instantaneous water heating assembly for heating up the water as supplied from the water pipe inlet side (26*a*) as may then be taken out thusly as hot water from the water pipe outlet side (25*b*). Designated further at (28) is an ignition plug and at (29) a flame detector, as provided for easy ignition of the combustible gas air mixture and for immediate automatic cutoff of the fuel supply in response to flame failure, respectively.

Provision of the flame-sustainer metallic netting (22) as illustrated in this burner of FIG. 8 further contributes to effective prevention of the lift of flame even with quite excessive supply of air, to thus enable by such excessive air supply ultimately to effectively abate exhaust CO and $NO_x$ contents, on the basis as is now described hereunder: Namely, the inventors of this invention noted that when burners having no such flame-sustainer metalic netting (22) are used under considerable combustion load and high excessive primary air ratio there is then a tendency of lift of the flame to occur in a portion of the combustion surface (2) near its end of the supporting connection to the burner body structural portion (4), and made investigation to reveal the cause that the temperature of the said connection end portion is so low in such case, owing to heat conduction from the metalic netting (1) to the burner body structural portion (4), as to fail to sustain there stable ignition of the gas. Various experiments were then made to find out how to prevent such failure, to result in confirming that provision of the flame-sustainer metallic netting (22) as described hereinabove serves effectively to prevent such lift of the flame, on account apparently that heat conduction from the flame-sustainer metallic netting (22) to the burner body structural portion (4) is hindered by the presence of the metallic netting (1) interposed therebetween, while that the flame-sustainer metallic netting (22) is intensively heated, on the one hand directly by the high-temperature tip-end portion of the flame built through the metallic netting (1) and on the other hand by radiant heat from the portion of the metallic netting (1) by nature of stable-flame combustion, and is thus stably maintained in sufficiently high temperature enough to sustain spontaneous ignition of the gas.

We claim:

1. A surface combustion type burner with a single-stage air supply of primary air and a fuel supply, comprising a tubular body portion, an elongated, perforated, metal base extending from and secured to said body portion to receive a mixture of primary air and fuel therein, said perforated metal base having a 5–15 percent perforation ratio, a 25–35 mesh metallic netting overlying said perforated metal base in close contact therewith, said metallic netting having a greater perforation ratio than said metal base, and a flame-sustainer metallic netting wrapped around an end portion of said metallic netting juxtaposed said body portion and around an end portion of said body portion adjacent said metallic netting to avoid flame lift, a combustion surface being defined by that portion of said metallic netting exposed from said flame-sustainer metallic netting.

2. The burner of claim 1 wherein said flame-sustainer metallic netting is 15–20 mesh, and has a coarser mesh than said metallic netting.

* * * * *